US006590504B1

(12) United States Patent
Hermann

(10) Patent No.: US 6,590,504 B1
(45) Date of Patent: Jul. 8, 2003

(54) METHOD AND APPARATUS FOR THE REMOTE CONTROLLED ACTUATION OF A CONTROL DEVICE

(75) Inventor: Helmut Hermann, Bochum (DE)

(73) Assignee: DBT Automation GmbH (DE)

( * ) Notice: Subject to any disclaimer, the term of this patent is extended or adjusted under 35 U.S.C. 154(b) by 395 days.

(21) Appl. No.: 09/589,488

(22) Filed: Jun. 7, 2000

(30) Foreign Application Priority Data

Jun. 7, 1999 (DE) ..... 199 25 721

(51) Int. Cl.[7] ..... G08C 19/00; E21D 23/12

(52) U.S. Cl. ..... 340/825.69; 340/825.72; 299/1.3

(58) Field of Search ..... 340/825.6, 825.62, 340/825.69, 825.7, 825.72, 10.1–10.6, 3.7, 3.71, 825.56; 341/176; 359/142, 143, 144, 145–148; 299/1.3

(56) References Cited

U.S. PATENT DOCUMENTS 4,831,539 A * 5/1989 Hagenbuch ..... 364/449
4,870,697 A * 9/1989 Weber ..... 455/70
5,029,943 A * 7/1991 Merriman ..... 299/1
5,079,640 A * 1/1992 Gfrerer ..... 359/144
5,588,009 A * 12/1996 Will ..... 371/33
5,917,425 A * 6/1999 Crimmins et al. ..... 340/852.49
5,995,888 A * 11/1999 Hagenbuch ..... 701/35
6,211,790 B1 * 4/2001 Radomsky et al. ..... 340/573.4
6,407,779 B1 * 6/2002 Herz ..... 348/734

* cited by examiner

*Primary Examiner*—Michael Horabik
*Assistant Examiner*—Nam V Nguyen
(74) *Attorney, Agent, or Firm*—Cook, Alex, McFarron, Manzo, Cummings & Mehler, Ltd.

(57) ABSTRACT

A method and apparatus for remotely controlled operation of one of several control devices (13) for support frames in underground mining in which the control device (13') to be actuated is selected by means of an infra-red remote operation and then the transmission of control data between a remote controller (16) and the selected control device (13) is effected by radio transmission. The remote controller, (16) has not only a radio transmitter (18) and the control devices (13) a radio receiver (15), but each control device (13) is additionally provided with at least one infra-red receiver (20), whereby by an infra-red data transmission, the control device (13') to be actuated is first deliberately selected by the remote controller (16), before the control data is then subsequently transmitted by radio.

7 Claims, 2 Drawing Sheets

METHOD AND APPARATUS FOR THE REMOTE CONTROLLED ACTUATION OF A CONTROL DEVICE

Figure 1:
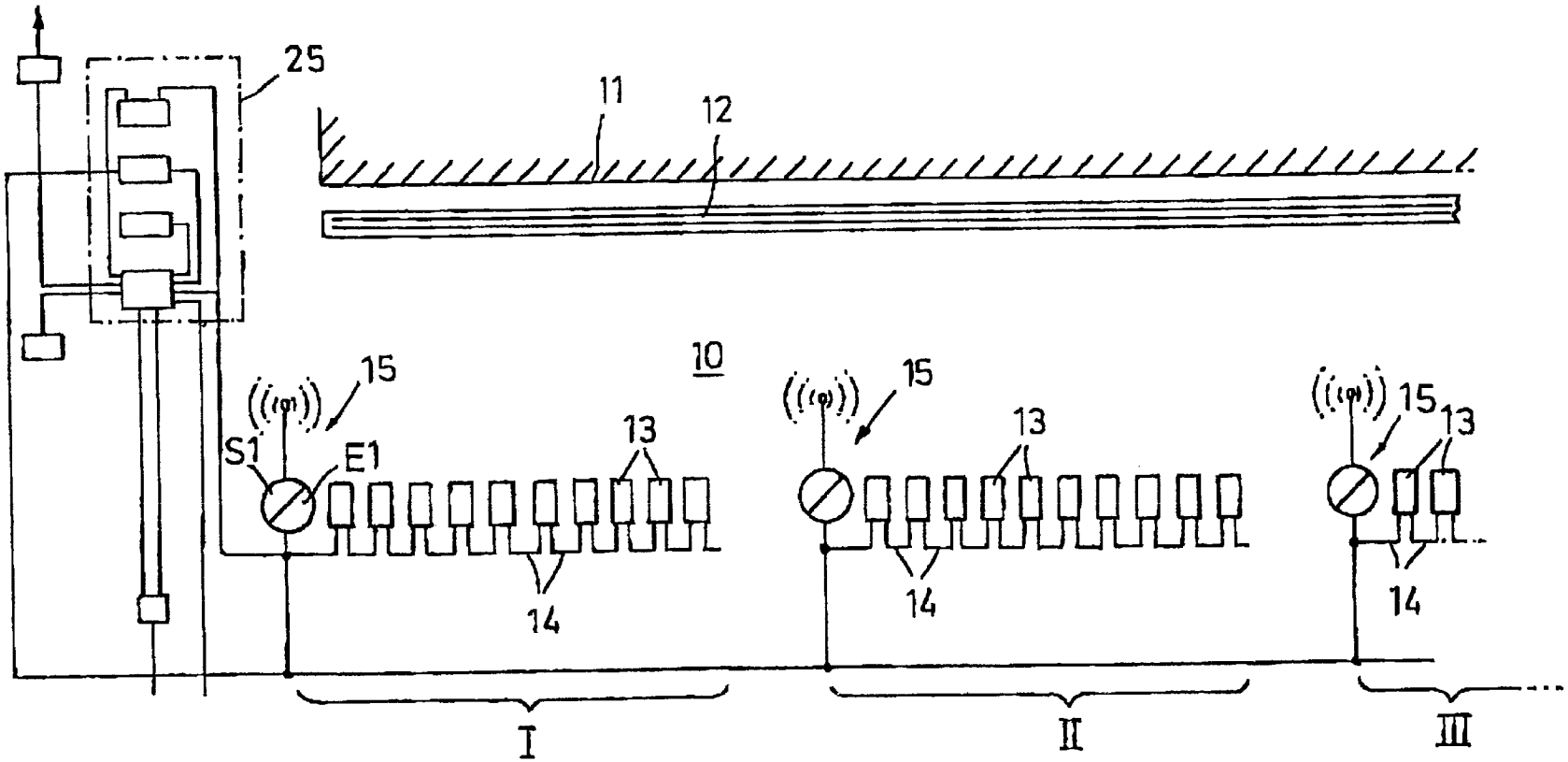

The present invention relates to a method for the remote controlled actuation of several control devices for support frames in underground mining by means of remote operation. The invention is further directed to an apparatus for the remote controlled actuation of one of several control devices for support frames in underground mining, with a remote controller with at least one radio transmitter and with at least one radio receiver for the control devices.

The face support frames applied in underground mining normally each have a control device, with which it is possible to actuate the individual assemblies in the support frame not only automatically via a central computer, but also, if required, to initiate the individual functions of the support frame manually. In order also to actuate a support frame manually from greater distances, actuation can also be remote controlled. A previously proposed remote control is the so-called neighbourhood control, in which the control unit of a support frame is connected to the control unit of a neighbouring support frame via a cable, so that a miner with the control equipment of one support frame can cause the neighbouring support frame to set, withdraw, step or otherwise actuate it.

In order to provide the miner with a greater play of movement for manual operation, it has been previously proposed that the control device of a support frame at a face be equipped with at least one radio receiver, so that it can be remotely operated using a radio transmitter. However, a problem with this radio remote control lies in that a directed selection of a control device over the radio transmission path is only possible if either each control device of a support frame has its own radio receiving section and its own associated remote control, whereby all the remote controls are distinguished by different transmission frequencies, or alternatively, by the use of only one remote control for all or several control devices it being necessary to allocate in advance a fixed identity to each control device, which must first be selected by the miner on the keyboard of the remote control, to select the control device to be actuated. In the event that the operator does not know the identity or network number of the control device to be actuated or transmits an incorrect identity over the remote control to the radio receiver for the control device, it can easily happen that the control device on the wrong support frame is actuated and this then unintentionally is withdrawn, jerked or otherwise moved, which in certain circumstances can lead to dangerous situations.

It is an aim of the present invention to address one or more of the aforementioned disadvantages, by producing a method and an apparatus of the construction described at the beginning of this specification, such that with it the desired control device to be actuated can be selected unambiguously even without knowledge of the identity assigned to the control device, whereby the transmission via radio of the control signals from the remote control to the control device should still be effected in a known reliable manner.

Accordingly, the present invention is directed to a method for remotely controlled activation of one of several control devices for support frames in underground mining by means of a remote controller, in which the control device to be actuated is selected by means of an infra-red remote controller land then the transmission of control data is effected between the remote controller and the selected control equipment is effected by radio transmission.

The present invention is also directed to An apparatus for the remotely controlled actuation of one of several control devices for support frames in underground mining comprising a remote controller with at least one radio transmitter and with at least one radio receiver for the control devices, in which each control device has at least one infra-red receiver and the remote controller has an infra-red transmitter, whereby the control device to be actuated can be selected by an infra-red transmission between the remote controller and the individual control device.

The invention utilises the fact that although in the transmission of data using radio the radio transmitter radiates over practically the whole area of space and therefore the directed selection of one receiver is not immediately possible, in contrast thereto, wireless infra-red transmission occurs only in a narrowly confined region, since the propagation angle for infra-red transmission is very small both for the received signal and for the transmitted signal. This means that for successful data transmission between an infra-red transmitter and an infrared receiver these must be deliberately directed towards.each other. Thus, when the remote controller with the infra-red transmitter is directed towards the control device to be actuated and a data transmission takes place between the infra-red receiver on the control device and the infra-red transmitter on the remote controller, the targeted control device is selected for the subsequent transmission of data by means of radio, whilst the other control devices do not receive the data transmitted by radio. The apparatus is preferably designed such that after a single successful selection of the control device to be actuated, the remote controller does not need to be directed towards it any longer, so that the miner can move completely freely in the face area for the subsequent transmission of the radio signals.

Advantageously several control devices are networked together on a data bus and have a common radio receiver. Preferably the remote controller has a radio receiver as well as the radio transmitters and in which the control device have in addition at least one radio transmitter. Radio communication between the remote controller and the control devices thereby is effected bi-directionally, so that not only can control commands be transmitted from the remote controller to the control devices, but in the reverse direction also, so that the remote controller can be instructed on the performance of the commands given.

In a preferred embodiment the radio transmitter and receiver are configured as a radio transceiver, and advantageously the infra-red transmitter and receiver are configured as an infra-red transceiver.

Advantageously, the remote controller has a keyboard unit and a display device, on which the miner can ascertain the instantaneous operating condition of the support frame to be actuated, even if he is at a greater distance from the support frame recently actuated.

Figure 2:
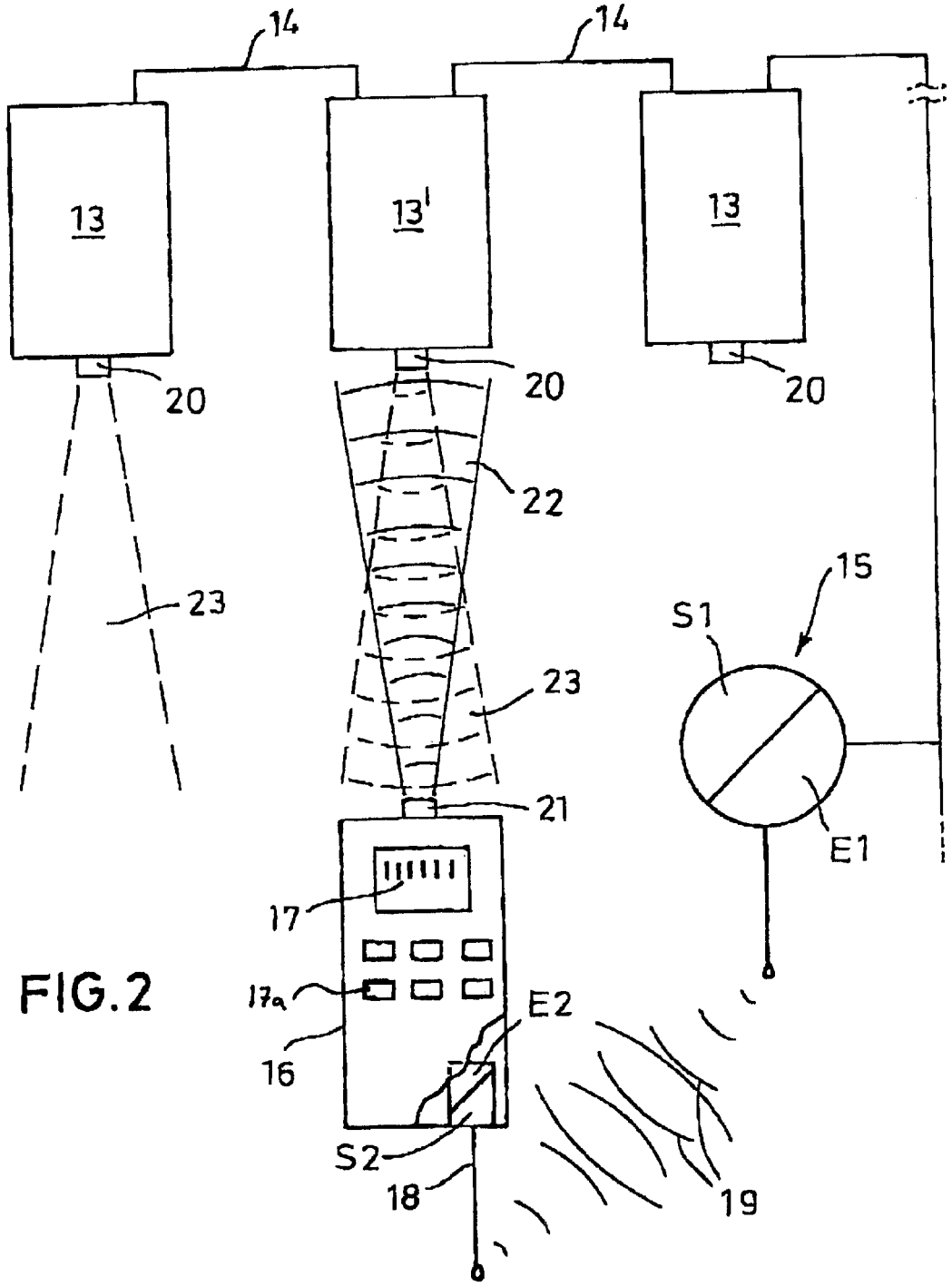

An example of an apparatus made in accordance with the present invention will now be described with reference to the accompanying drawings, in which:

FIG. 1 shows a schematic representation of an electro-hydraulic support frame for underground mining in the end region of an extraction face with Be several mining and individual control devices;and FIG. 2 shows a schematic representation of a part of the individual control device with a remote controller actuating it.

In FIG. 1 the end region of an extraction face 10 is shown, which typically has an overall length of more than 200 m. In front of the face 11, in a previously proposed configuration is a face conveyor 12 at the extraction face on which an extraction machine (not shown), for instance a coal plough or a drum cutting machine, moves along. On the side of the face 11 opposite to the face conveyor 12 there is, in a previously proposed configuration, a powered face support with hydraulic support frames arranged in a row alongside each other, which for reasons of clarity are similarly not shown.

To each of the support frames (not shown) there is assigned a control device 13, whereby in the embodiment shown the control devices 13 are grouped together into control device groups I, II, III, each group having ten control devices 13 networked together amongst each other via a data bus 14. All the control devices 13 in a device group I, II, III, are assigned a common radio transmitting and receiving unit 15 with a radio transmitter S1 and a radio receiver E1.

The radio transmitting and receiving unit 15 serves for the remote controlled actuation of the individual control devices 13 assembled in the device group, with the aid of a remote controller 16, which is shown in greater detail in FIG. 2.

The remote controller 16 comprises hand-held equipment, which in a previously proposed manner is provided with a keyboard 17*a* and a display unit 17. For the transmission of control commands, the remote controller 16 is similarly provided with a radio transceiver 18, which is a combined radio transmitting and receiving unit S2, E2, which can transmit data by radio to the radio transmitting and receiving unit 15 of the control device 13 of a device group and can receive from it,as indicated radio waves 19.

For the targeted selection of the, control device to be actuated these each have an infra-red transceiver 20, and the remote controller similarly has an infra-red transceiver 21 on its front side, with which it is possible, via wireless infra-red remote communication, to set up a link between the remote controller 16 and the selected control device 13' to be actuated. The infra-red signals from the infra-red transceivers 20, 21 do not radiate over a wide angle like the radio signals 19, but both the transmitted signal region 22 of the infra-red transceiver 21 and also the receive region 23 of the infra-red transceiver 20 on the control device 13' are similarly narrow, so that infra-red communication between the remote controller 16 and the control device 13' is only effected if the transmit region 22 and the receive region 23 overlap each other.

Since the infra-red transmission between the remote controller 16 and the control device 13' only occurs in the narrow transmit and receive regions 22, 23, it is possible by the transmission of an infra-red command to the control device 13' for the latter to be purposely selected, whereupon a computer unit 25, connected via the data bus 14, bars all the other, unselected control devices 13 from radio actuation, so that the subsequent control commands transmitted over the radio transceivers 18, 15 are processed only by the control equipment 13', which has been previously selected by the infra-red transmission. In the transmission of control data over the radio path it is also no longer necessary to direct the remote controller 16 towards the control device 13' to be actuated, and it is also not necessary to maintain the same spatial proximity to the control device 13' as is required for the successful infra-red data transmission between the control device 13' and the remote controller 16. The invention is not limited to the embodiment shown and described, as various modifications and extensions will be apparent which do not depart from the scope of the invention. For instance it is possible not to provide a common radio receiving unit for several control devices, but to provide each control device its own radio transmitting and/or receiving unit, which is activated by the transmission of an infra-red signal for the subsequent transmission of radio commands.

I claim:

1. A method for remotely controlled actuation of one of several control devices for support frames in underground mining by means of a remote controller, in which the control device to be actuated is selected by means of an infra-red controller, a computer unit connected to the control devices bars all other unselected control devices from radio actuation, and then the selected control device is then released for the reception of control data by radio transmission.

2. An apparatus for the remotely controlled actuation of one of several control devices for support frames in underground mining comprising a remote controller with at least one radio transmitter and with at least one radio receiver for the control devices, in which each control device has at least one infra-red receiver and the remote controller has an infra-red transmitter, whereby the control device to be actuated can be selected by an infra-red transmission between the remote controller and the individual control device, and a computer unit connected to the control devices bars all other, unselected control devices from radio actuation.

3. An apparatus according to claim 2, in which several control devices are networked together on a data bus and have a common radio receiver.

4. An apparatus according to claim 2, in which the remote controller has a radio receiver as well as the radio transmitter and in which the control devices have in addition at least one radio transmitter.

5. An apparatus according to claim 2, in which the radio transmitter and receiver are configured as a radio transceiver.

6. An apparatus according to claim 2, in which the infra-red transmitter and receiver are configured as an infra-red transceiver.

7. An apparatus according to claim 2, in which the remote controller has a keyboard unit and a display device.

* * * * *